US008393950B1

(12) United States Patent
White

(10) Patent No.: US 8,393,950 B1
(45) Date of Patent: Mar. 12, 2013

(54) METHOD AND APPARATUS FOR A WAGERING GAME HAVING A SECONDARY GAME ARRAY FORMED FROM A PLURALITY OF PRIMARY GAME ARRAYS

(75) Inventor: Michael L. White, Glenview, IL (US)

(73) Assignee: Primo Innovo, LLC, Glenview, IL (US)

( * ) Notice: Subject to any disclaimer, the term of this patent is extended or adjusted under 35 U.S.C. 154(b) by 696 days.

(21) Appl. No.: 12/584,447

(22) Filed: Sep. 4, 2009

(51) Int. Cl.
*A63F 9/24* (2006.01)

(52) U.S. Cl. ..... 463/20

(58) Field of Classification Search ..... 463/16–25
See application file for complete search history.

(56) References Cited

U.S. PATENT DOCUMENTS

| | | | | |
|---|---|---|---|---|
| 4,198,052 | A | 4/1980 | Gauselmann | |
| 4,805,907 | A | 2/1989 | Hagiwara | |
| 5,611,535 | A | 3/1997 | Tiberio | |
| 6,227,971 | B1 * | 5/2001 | Weiss | 463/20 |
| 6,652,378 | B2 | 11/2003 | Cannon | |
| 6,935,947 | B1 * | 8/2005 | Singer et al. | 463/16 |
| 7,402,102 | B2 | 7/2008 | Marks | |
| 2003/0104855 | A1 * | 6/2003 | McClintic | 463/16 |
| 2004/0157659 | A1 * | 8/2004 | Fox | 463/20 |
| 2005/0101379 | A1 | 5/2005 | Falconer | |
| 2007/0232384 | A1 | 10/2007 | Pace | |
| 2009/0093296 | A1 * | 4/2009 | Gerson et al. | 463/20 |
| 2009/0156287 | A1 | 6/2009 | Baumgartner | |
| 2009/0215521 | A1 | 8/2009 | Borissov | |
| 2011/0105218 | A1 * | 5/2011 | Anderson et al. | 463/20 |

* cited by examiner

*Primary Examiner* — Melba Bumgarner
*Assistant Examiner* — Anh Vo V Nguyen
(74) *Attorney, Agent, or Firm* — Michael L. White

(57) ABSTRACT

The player makes a wager to receive a plurality of primary game arrays. Winning primary game outcomes occur when specific primary game array positions, designated by paylines, are randomly assigned winning combinations of indicia. The winning game outcomes of a plurality of primary game arrays are converted to symbols corresponding to the winning primary game outcomes to form a secondary game array. Winning secondary game outcomes occur when winning combinations of symbols occur on the secondary game array paylines.

19 Claims, 6 Drawing Sheets

METHOD AND APPARATUS FOR A WAGERING GAME HAVING A SECONDARY GAME ARRAY FORMED FROM A PLURALITY OF PRIMARY GAME ARRAYS

FIELD OF THE INVENTION

This invention relates to gaming, and more particularly, in one embodiment, to wagering games for gaming machines.

BACKGROUND OF THE INVENTION

Gaming machines are a popular form of entertainment with gaming establishment patrons. Slot-type gaming machines form an array of randomly selected indicia. Winning game outcomes occur when specific array positions, designated by paylines, are randomly assigned winning combinations of indicia.

SUMMARY OF THE INVENTION

In one embodiment, a wagering game forms a secondary game array from the game outcomes received from a plurality of primary game arrays. The array positions of the primary game arrays are assigned randomly selected indicia from an indicia set. In one embodiment, a winning primary game outcome occurs when a winning combination of indicia occurs on an active payline (i.e., a payline on which a wager has been placed). In this embodiment, a corresponding symbol is determined for each of the winning primary game outcomes from which a secondary array is formed with the determined symbols. A winning secondary game outcome occurs when a winning combination of symbols occurs in predetermined array positions in the secondary array.

In one embodiment, to more clearly visualize the game, each of the primary game arrays are assigned to one of the array positions in the secondary game array. The determined symbols for each winning primary game outcome replace the corresponding winning primary game array to form the secondary game array.

BRIEF DESCRIPTION OF THE FIGURES

Various embodiments of the wagering game are illustrated in the accompanying figures. The figures are provided as examples only and are not intended to be considered as limitations to the invention. Similarly, numerical entries only represent exemplary information, and those skilled in the art understand that a variety of different values and alternate arrangements can be made. Consequently, the wagering game is illustrated by way of example and not by limitation in the accompanying figures in which.

DETAILED DESCRIPTION

The wagering game described in the following embodiments may be adapted for play on gaming machines similar to those commonly found in gaming establishments. Gaming machines are typically networked into a gaming system that facilitates the monitoring and support of each gaming machine in the system.

Figure 1:
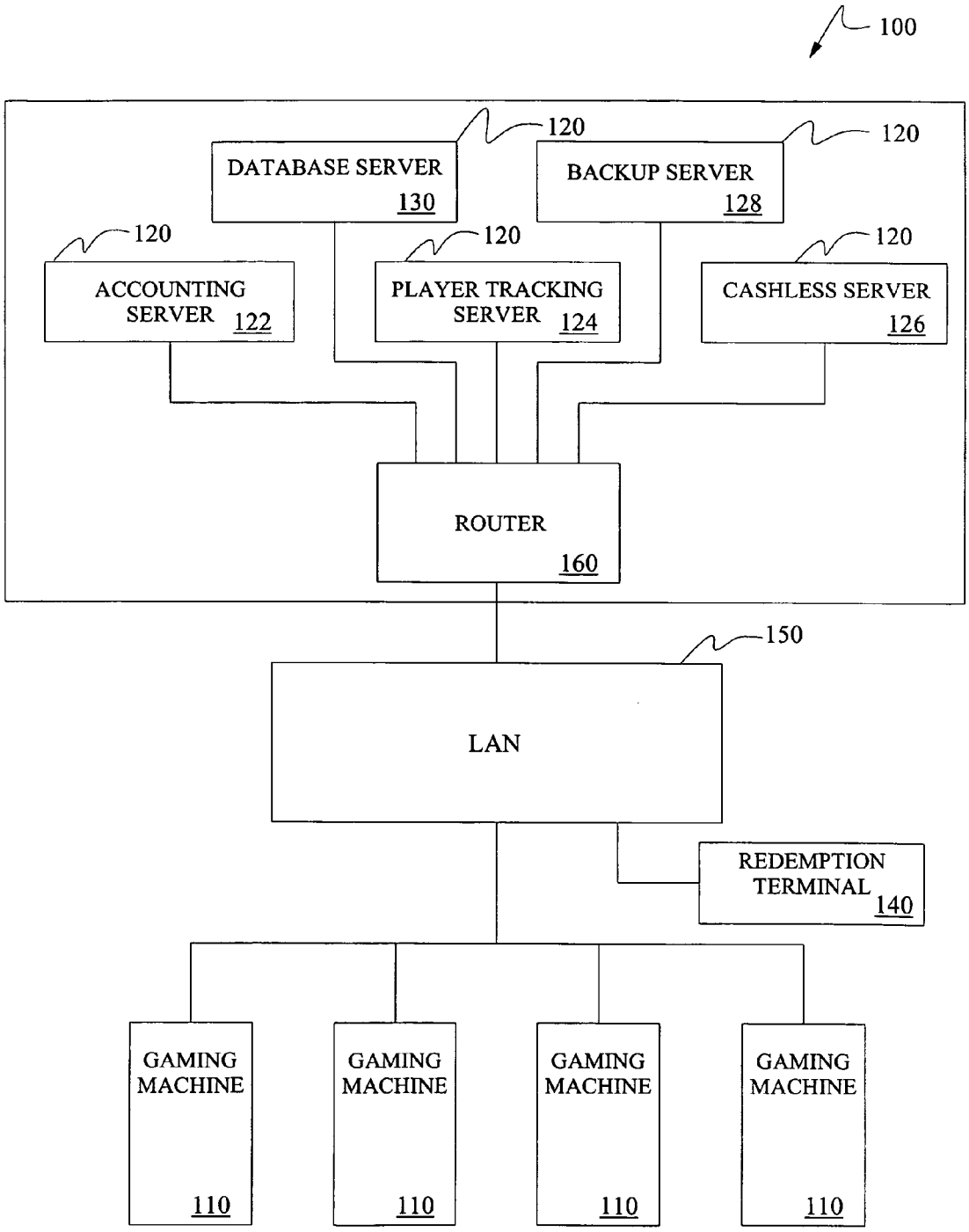
FIG. 1 is an exemplary block diagram of a gaming system.

Referring to FIG. 1, an exemplary gaming system 100 is illustrated. Gaming machines 110 on the floor of a gaming establishment are typically in communication with a plurality of servers 120 that provide ancillary support services for wagering activity at each gaming machine. These servers 120 and the gaming machines 110 are connected in a communications network (e.g., a local area network (LAN) 150 electronically linking the gaming system 100 together. Other network devices such as routers 160, storage devices (e.g., a database server 130), and backup servers 128 may also be part of the gaming system 100.

Servers 120 commonly found in some gaming systems include an accounting server 122 (records wagers and payouts), a player-tracking server 124 (tracks wagering activity of individual players), and a cashless server 126 (assists with the issue and redemption of wagering vouchers). Although it is common practice to use several different servers, each dedicated to a particular gaming function, it is also possible to bundle different gaming functions together for execution on a single server.

The player-tracking server 124 maintains a record of the player's wagering activity, allowing the gaming establishment to reward gaming patrons commensurate with their wagering activity. A player-tracking card is commonly provided to gaming patrons for participation in player loyalty programs sponsored by the gaming establishment. The player-tracking card is encoded with a unique player identification number, allowing the player-tracking server 124 to maintain a record of player wagering activity.

The cashless server 126 maintains a database of issued and redeemed vouchers. Vouchers are typically paper tickets with an imprinted monetary value that facilitates wagering. These vouchers are printed and accepted by gaming machines 110 to allow players to make wagers and cash out of the gaming machine without paper currency or coins. Each wagering voucher has a unique barcode identifier that acts as an index to a file in a database for retrieving information regarding the voucher (e.g., the specific monetary value of the voucher). Typically, the cashless server 126 stores this information in its database for recall when the voucher is presented for redemption.

When presented to a gaming machine 110, the voucher's barcode information is communicated to the cashless server 126, and the voucher is validated. The voucher value is communicated to the gaming machine 110 and credited for play on the gaming machine.

Other devices in the gaming system 100 may be present and in communication with the local area network 150. For example, a redemption terminal 140 (e.g., a computer terminal for a cashier or a self-serve kiosk) may be available to allow a player to cash out a voucher. This redemption terminal 140 is typically in communication with the cashless server 126 to facilitate monetary transactions.

The gaming machines 110, servers 120, and other network devices typically use serial communication protocols for transferring data over the gaming system's local area network 150. In other embodiments, gaming systems 100 may use Ethernet type communication protocols or any other communication protocol using any number of different types of communication media (including, e.g., optical fiber, radiofrequency, etc.).

In most gaming systems, the gaming machine 110 determines the game outcome and the servers 120 support the wagering and data collection activities of each gaming machine. A game program (i.e., software) controls the gaming machine 110 and is executed with a CPU (central processing unit or simply a processor) in the gaming machine to determine the game outcome.

In other gaming systems, in lieu of executing a game program from a CPU in the gaming machine, the execution of the game program is performed by a CPU in a game server (not shown). For example, in one embodiment, the game server may execute a game program in response to initiation of the wagering game at a gaming machine 110. In this gaming system embodiment, the game server may perform all game program calculations and transmit video data to the gaming machine for display. Player selections may be transmitted from the gaming machine to the game server for further execution by the game program.

Alternatively, in still another gaming system embodiment, a CPU in the gaming machine and a CPU in a game server may each execute portions of a game program. For example, the game server may be limited to determining and transmitting random numbers to the gaming machine. The gaming machine uses these random numbers to determine, either directly or indirectly, game outcomes. Consequently, in one embodiment, the gaming system may be considered the gaming machine as the game program may be executed by a number of different discrete electronic devices (e.g., the game server and gaming machine as well as any other devices needed to execute the game program). In other embodiments, only the gaming machine 110, as depicted in FIG. 1, is necessary to execute the game program.

The gaming machine 110 illustrated in FIG. 1 is typically either an electro-mechanical gaming machine or a video gaming machine. The electro-mechanical gaming machine has mechanical reels to display game outcomes. In contrast, video gaming machines have a video display for displaying game outcomes. With the exception of the game presentation (i.e., either mechanical reels or a video display), both types of gaming machines operate using the same basic principles.

Figure 2:
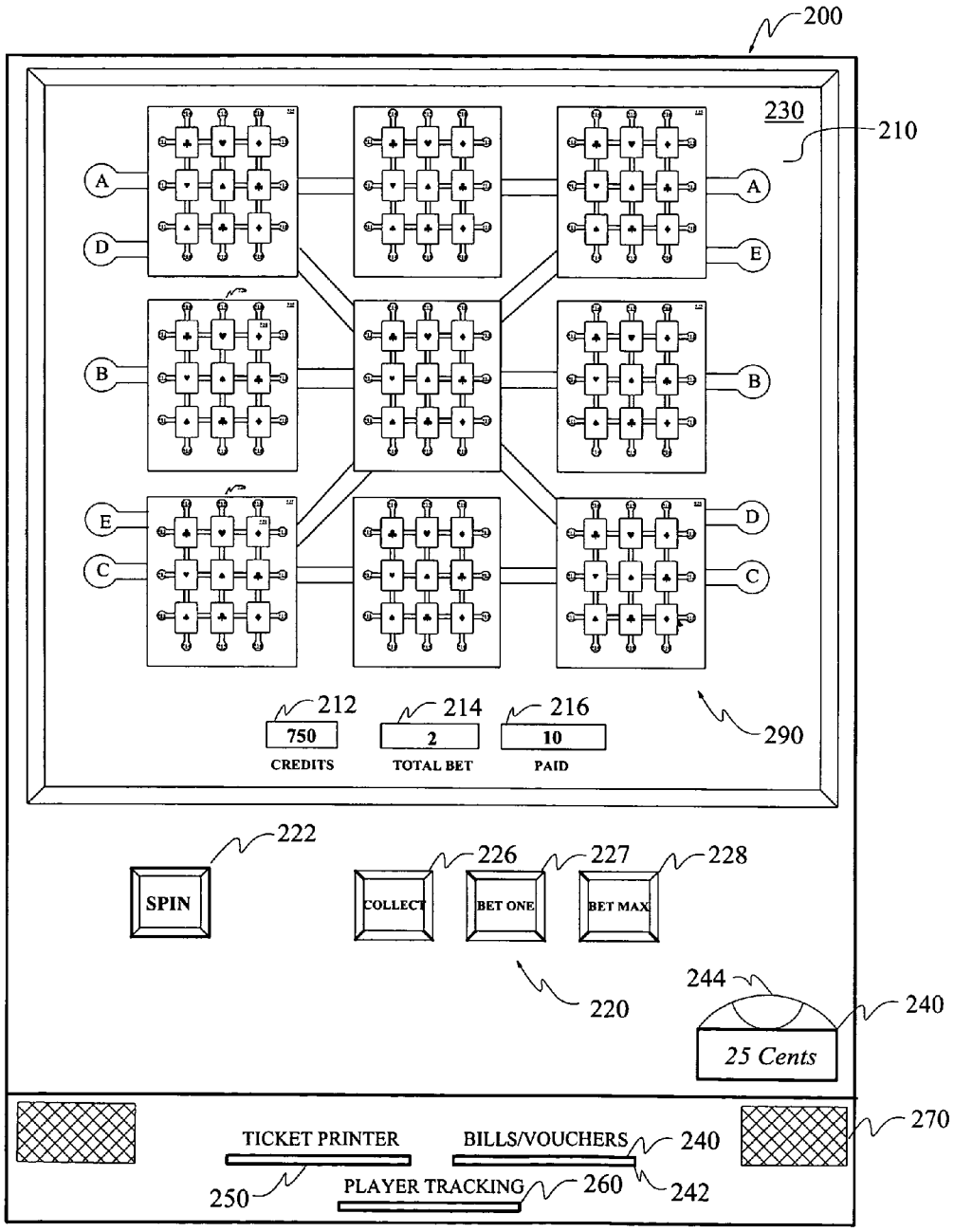
FIG. 2 is an orthogonal view of one embodiment of the gaming machine illustrated in FIG. 1.

FIG. 2 illustrates one embodiment of the gaming machine 110 depicted in FIG. 1. FIG. 2 depicts a video gaming machine 200 specifically adapted for play of the wagering game 290. The video gaming machine 200 has a wager acceptor 240 for initiating game play. The wager acceptor 240 may be a bill validator 242 (for accepting paper currency), a coin acceptor, or any other device capable of receiving and registering some form of acceptable monetary value. The bill validator 242 may, in some embodiments, also accept wagering vouchers.

As discussed above, vouchers are printed by some video gaming machines 200 in lieu of paying coins when a player cashes out of the gaming machine. The video gaming machine 200, in this embodiment, has a ticket printer 250 which prints a voucher for the value of the cash out from the gaming machine. Typically, the voucher may be redeemed by a video gaming machine 200 by inserting the voucher into the bill validator 242. The bill validator 242 reads the barcode printed on the voucher, communicates with the cashless server to determine the value of the voucher, and the video gaming machine 200 is credited for the value of the voucher.

The video gaming machine 200, in some embodiments, may have an alternative or additional payout mechanism such as a coin hopper (not shown on FIG. 2) internal to the gaming machine. The coin hopper dispenses coins to the player when the player cashes out.

The video gaming machine 200 may also include a card reader 260 for reading an identification card commonly known as a player-tracking card. The card reader 260 reads the player-tracking card and communicates the player's identification number to a player-tracking server.

Game play is initiated when the video gaming machine 200 receives a wager. The wagering game 290, in one embodiment, is displayed on the video display 210 of the video gaming machine 200. The video display 210 is generally a CRT or flat-panel display such as a LED or plasma display. Other types of displays may also be used to present the wagering game 290.

The video display 210 may also have a video representation of wagering meters to provide wagering information to the player. The meter display may include a credit meter 212 (displays total credits available for wagering), total bet meter 214 (displays the number of credits bet on each payline), and a paid credit meter 216 (displays payoff credits obtained from a winning game outcome).

In some embodiments, the player may make wagering selections using a pushbutton panel 220. For example, the player may designate the amount wagered on each individual payline (e.g., the bet one pushbutton 227 and the bet max pushbutton 228), the start of the game (e.g., the game start pushbutton 222), and the collection of credits on the gaming machine (e.g., using the collect pushbutton 226).

The video display 210 may operate, in some embodiments, in conjunction with a touch screen 230. To facilitate the play of a plurality of different games on a single video gaming machine 200, the touch screen 230 may serve as a means for inputting player selections. Icons representing various potential player selections may be presented on the video display 210. The player may touch an icon presented on the video display 210 to implement the corresponding function represented by the icon. In one embodiment the touch screen 230 may be used exclusively to control game play—eliminating the need for a pushbutton panel 220. In other embodiments, a combination of the pushbutton panel 220 and the touch screen 230 may be used to execute the player's game play decisions.

In addition, the video gaming machine 200 may provide sound effects or music to accompany game play through speakers 270. The speakers 270 may also provide game play information (e.g., audio help for the player).

Figure 3:
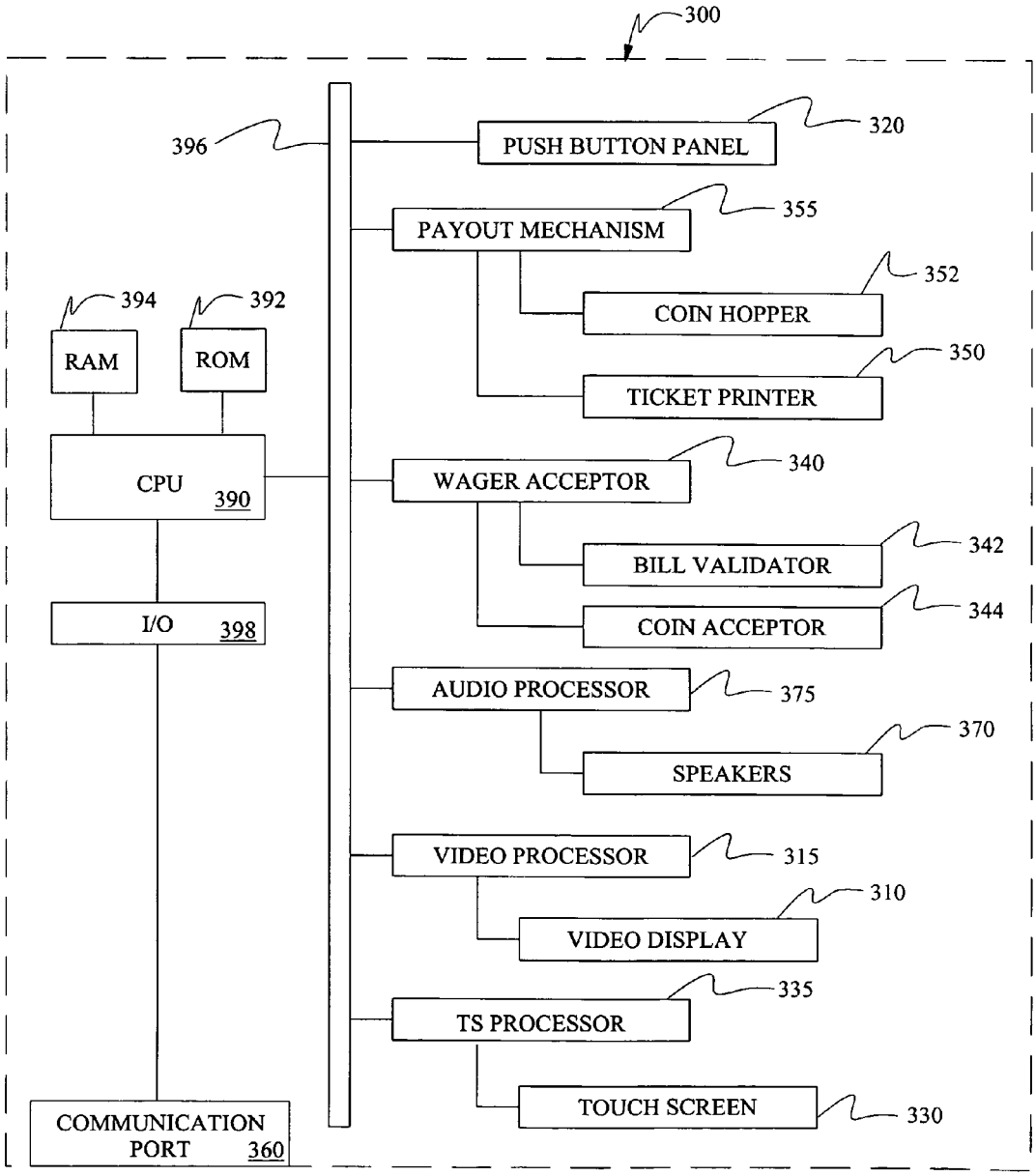
FIG. 3 is an exemplary block diagram of one embodiment of the control system of the gaming machine of FIG. 2.

With reference to FIG. 3, an exemplary control block diagram 300 is provided depicting the operational control of one embodiment of the video gaming machine 200 illustrated in FIG. 2. The central processing unit (CPU) 390, among other functions, controls the operation of peripheral devices ancillary to the operation of the gaming machine through the execution of the game program.

The CPU 390 has an internal I/O bus 396 to control communications between the CPU and the gaming machine's peripheral devices. The CPU 390 generally controls, either directly or indirectly, the bill validator 342 and coin acceptor 344 (more generally known as wager acceptors 340), the video display 310 (output controlled by video processor 315), the pushbutton panel 320, the coin hopper 352 and ticket printer 350 (more generally known as payout mechanisms 355), speakers 370 (output controlled by audio processor 375), and the touch screen 330 (input monitored by touch screen processor 335).

The CPU 390 not only controls and communicates with peripheral devices inside the gaming machine, but is also in communication with various servers that provide ancillary support services through a communication network as previously discussed. Consequently, the CPU 390 has an external I/O bus 398 to exchange data with the communication network through the communication port 360 in the gaming machine.

In addition to controlling each of the gaming machine's peripheral devices, the CPU 390 (through the execution of the game program) also controls game play. The gaming machine has both non-volatile read-only memory (ROM) 392 in which the game program is stored and volatile random access memory (RAM) 394 from which the game program is executed by the CPU 390. In other embodiments, other electronic devices and specialty components may replace the ROM 392 and RAM 394 in the gaming machine including DRAM, disk drives, and flash memory.

The game play displayed by the gaming machine is typically determined by the CPU 390. In one embodiment, the CPU 390 randomly selects indicia from an indicia set by generating a random number with a random number generator (not shown). The random number generator (RNG) employs a mathematical formula to determine a random number using a numerical seed to start the mathematical computation. This numerical seed may be, for example, taken from a continuously rolling counter at the time the player initiates game play.

In one embodiment, the random number determined is within a predetermined numerical range and corresponds to a game outcome listed in a probability table stored in memory. In one embodiment, a separate random number is generated to determine each indicium in the wagering game.

The probability table determines the probability of occurrence of any game outcome by associating each of the random numbers in a given range with a game outcome. The probability table may be weighted to achieve a desired game outcome distribution over a large number of game outcomes. This probability table in conjunction with a pay table listing the awards for winning game outcomes may be used to determine the gaming machine's payback percentage.

Once the indicia have been selected, the indicia are displayed to the player on the video display. More specifically, the CPU 390 in the video gaming machine signals the video processor 315 to display the wagering game on the video display 310.

With a general understanding of gaming machine operation, the wagering game executed by the game program may be described in further detail. The wagering game is described below in conjunction with the process flowchart 400 of FIG. 4 which depicts one exemplary embodiment of the game program.

Figure 4:
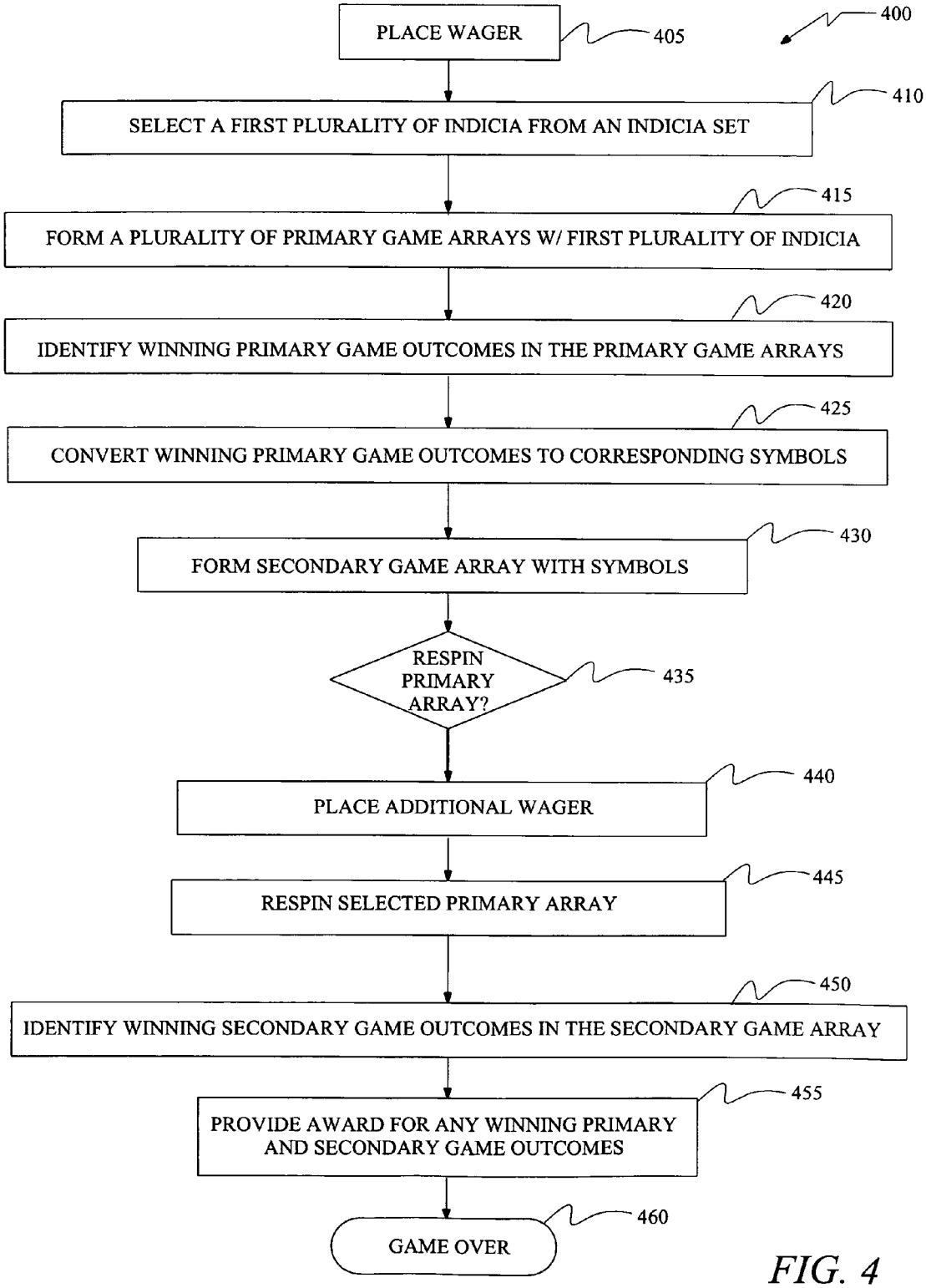
FIG. 4 is an exemplary process flowchart illustrating the game play of one embodiment of the wagering game.

Referring to FIG. 4, the wagering game starts with a wager in step 405. The gaming machine then randomly selects a first plurality of indicia from an indicia set in step 410. In step 415, a plurality of primary game arrays is formed from the first plurality of indicia. In step 420, each of the primary game arrays is examined to identify winning primary game outcomes.

In one embodiment, in step 425, each of the winning primary game outcomes is converted to a symbol corresponding to the type of winning primary game outcome received. In step 430, a secondary game array is formed with the symbols determined in step 425.

In one embodiment, the player now has an option in step 435 to receive a different game outcome (e.g., respin the reels of the game array) for one of the primary game arrays. This provides the player an opportunity to strategically assess the potential for increasing the likelihood of a winning secondary game outcome against the cost of the additional wager for a different primary game outcome. This game play option is not available in all embodiments of the wagering game. In certain embodiments that do allow the option, an additional wager is placed in step 440. The primary game array selected receives a different game outcome in step 445.

In the event that the player decides not to place the additional wager for a different outcome in step 435, or after the primary array is respun in step 445, the gaming machine identifies winning secondary game outcomes in step 450.

In one embodiment, awards are provided for winning primary and secondary game outcomes in step 455. The winning game outcomes for the primary and secondary games may be determined from pay tables which list all possible winning combinations of indicia and their corresponding award. The game is over in step 460.

The embodiment described by the process flowchart 400 of FIG. 4 is but one embodiment of the wagering game. Other game play variations include a variety of methodologies for producing different game outcomes. For example, in some embodiments, a different game outcome is produced with the random selection of a second plurality of indicia from the indicia set to form a new primary game array. Alternatively, the indicia in the primary game array may simply be randomized in the array to create a different primary game outcome. In some embodiments, the option of receiving a different primary game outcome is not available and steps 435 through 445 are eliminated.

Figure 5:
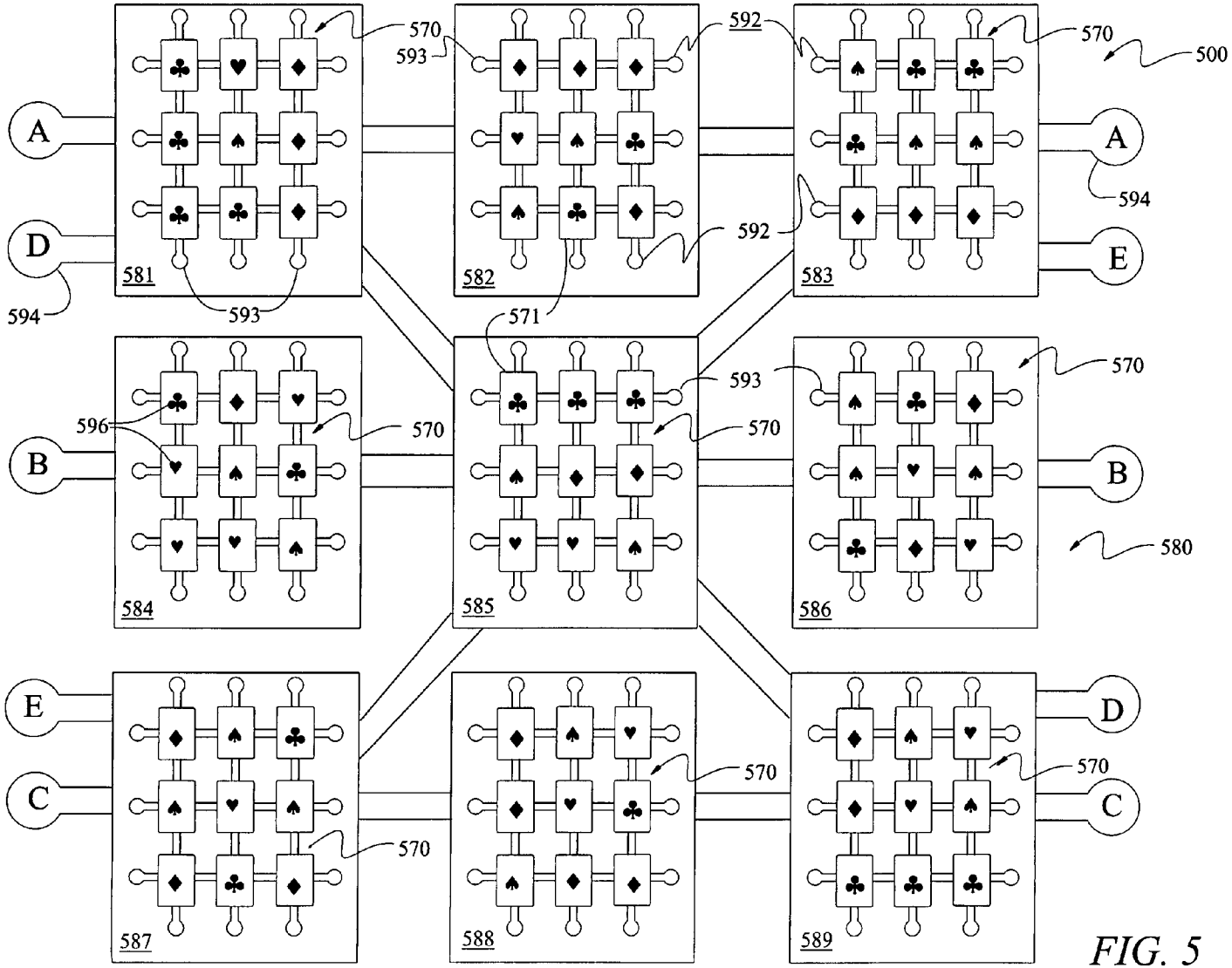
FIG. 5 is an exemplary illustration of a plurality of primary game arrays in one embodiment of the wagering game.

Turning to FIG. 5, a wagering game 500 is illustrated having a plurality of primary game arrays 570 and game outcomes designated by the primary game array paylines 592. Each primary game array has a plurality of primary array positions 571 having a randomly selected indicium.

In one embodiment, the primary game arrays 570 have three rows and three columns with primary game array paylines 592 through the rows and columns of the array. In this embodiment, the plurality of primary game arrays 570 are assigned to secondary game array positions 581-589 arranged to form a secondary game array 580. The secondary game array 580 has a plurality of secondary game array paylines 594. In this embodiment, the secondary game array paylines 594 include the rows and the two diagonals through the secondary game array 580.

Other embodiments of this wagering game may include different numbers and types of payline geometry. In addition, the number of paylines available to the player may be a function of the wager amount.

As noted above, the primary game arrays 570 are developed with randomly selected indicia 596 from an indicia set. Each of the primary game arrays 570 may be selected from an independent indicia set or from one single indicia set. In this exemplary embodiment, the indicia set comprises the suits found in a standard card deck (i.e., Hearts, Diamonds, Spades, and Clubs) and are used in this example as slot machine symbols. In one embodiment, a winning primary game outcome 593 requires three identical indicia 596 on an active primary game array payline 592 to be eligible for an award (e.g., three Diamond indicia).

The game commences with the player's wager. In response, the player receives a plurality of primary game arrays 570 (in this embodiment, nine individual primary game arrays). Once the primary game arrays 570 have been determined, each individual primary game array payline 592 can be evaluated for a winning game outcome.

As depicted by FIG. 5, the primary game arrays 570 in secondary array positions 581, 582, 583, 585, and 589, have winning primary game outcomes 593. The winning primary game outcomes 593 in the primary game arrays 570 are the: 1) three Diamond indicia in secondary array positions 581, 582, and 583; and, 2) three Club indicia in secondary array positions 581, 585, and 589. The winning primary game outcomes in each of the primary game arrays may be converted, in one embodiment, to a symbol corresponding to the winning primary game outcome and used to potentially form a winning secondary game outcome.

Figure 6:
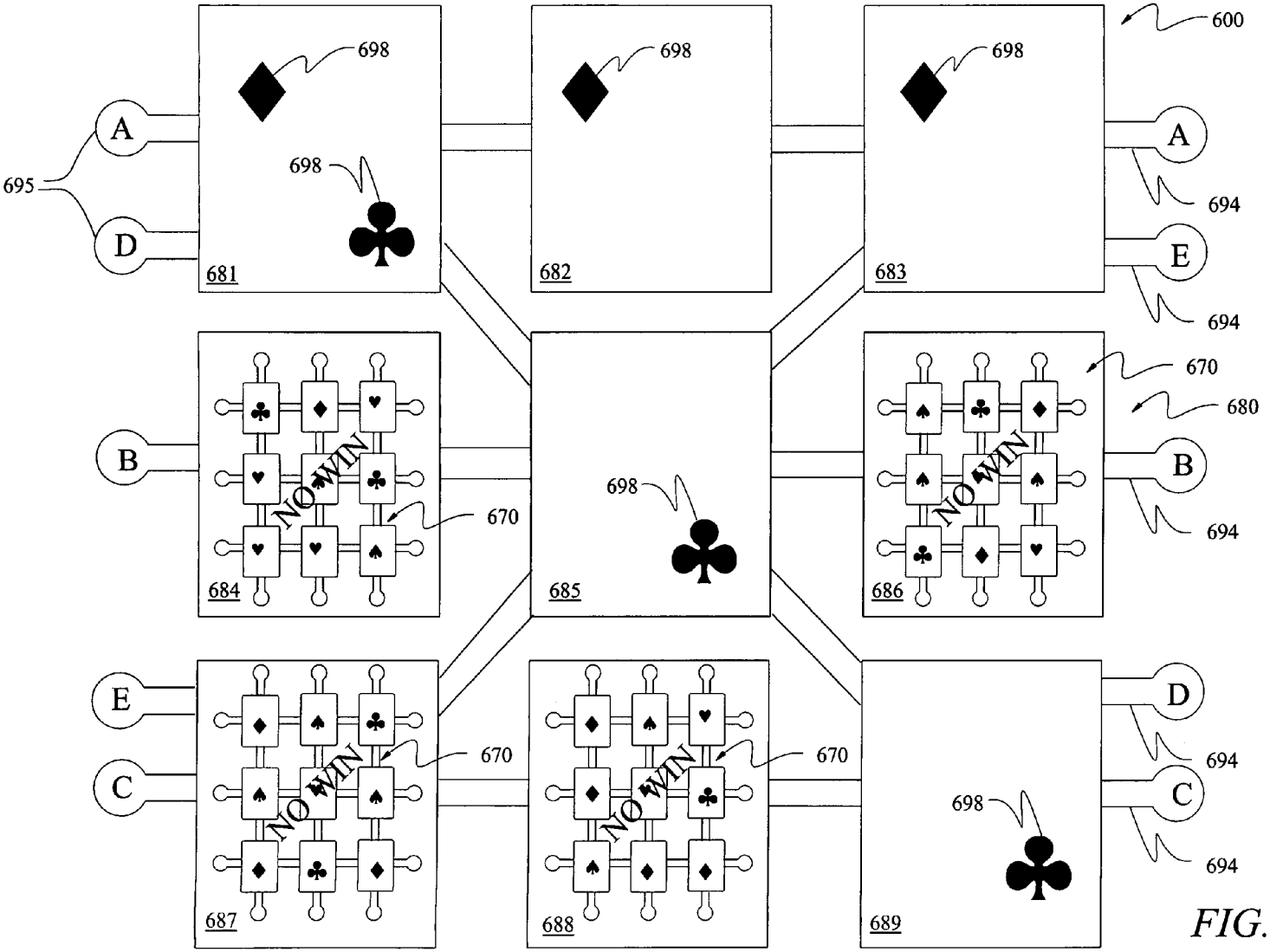
FIG. 6 is an exemplary illustration of a secondary game array developed from the primary game arrays illustrated in FIG. 5.

Referring to FIG. 6, the wagering game 600 is depicted, further developed and illustrating a final game outcome of the game play illustrated in FIG. 5. FIG. 6 illustrates the substitution of the symbols 698 determined for each of the corresponding winning primary game outcomes for each of the winning primary game arrays. This forms a secondary game outcome in secondary game array 680 having secondary game array positions 681-689. In this embodiment, the non-winning primary game arrays do not have the potential for creating a winning secondary game outcome 695. The primary game arrays 670 without a winning game outcome may be left as is in the secondary game array 680, or otherwise indicated as a non-winning primary game outcome.

For example, in the primary game array as discussed above, five of the primary game arrays have winning game outcomes. These winning game outcomes have been converted to corresponding symbols 698 in the secondary game array 680. The two winning primary game outcomes in array position 681 have been converted to a Diamond symbol and a Club symbol. Similarly, array positions 682 and 683 have been replaced with Diamond symbols and array positions 685 and 689 have been replaced with Club symbols.

In this embodiment, the indicia only determine winning primary game outcomes in the primary game arrays. In contrast, the symbols (although they appear the same except for size) only determine winning secondary game outcomes 695 in the secondary game array 680. In this embodiment, the symbols have been made substantially larger than the indicia to easily distinguish the indicia from the symbols. In other embodiments, the symbols may bear no resemblance to the indicia.

Although the symbols are similar to the indicia selected from the indicia set, in this embodiment, they produce entirely different game outcomes than the indicia used to form the primary game outcomes. For example, in this embodiment, more than one symbol may occupy a single secondary game array position. In addition, the symbols may produce a winning secondary game outcome that, in one embodiment, is paid from a different pay table and produces a different payback percentage for the player.

Alternatively, an entirely differently themed symbol set could be used to more clearly distinguish the secondary game from the primary game. For example, instead of card suit symbols, the symbols in the secondary game could be standard slot symbols such as cherries, oranges, lemons, and watermelons.

The secondary game array 680 can now be evaluated for a winning secondary game outcome 695. Similar to the primary game array pay table, in this one embodiment, the secondary game array pay table provides a winning game outcome for three identical symbols on an active payline. Such an exemplary winning secondary game outcome 695 has occurred with three Diamond symbols on the secondary payline 694 designating array positions 681, 682, and 683; and three Club symbols on the secondary payline designating array positions 681, 685, and 689. The remaining secondary paylines 694 do not have the three identical indicia required for a winning secondary game outcome.

In the embodiment illustrated in FIG. 5 and FIG. 6, the player is not provided an opportunity to respin one of the losing primary game arrays and receive a new primary game array. In other embodiments that do allow the respin of one of the primary game arrays, the player might place a wager and select one of the non-winning primary game arrays in the secondary game array to be respun (e.g., the primary game arrays in secondary array positions 684, 686, 687, and 688). If the respun primary game array has a winning primary game outcome, the primary game outcome is converted to a symbol and assigned to the secondary game array for further evaluation for a winning secondary game outcome.

In general, any type of wagering or non-wagering game that requires the collection of specified indicia to form a winning game outcome may be adapted for play in this game. For example, most card games can be implemented in the primary game array. These card games include, for example, and not all-inclusive, Poker, Blackjack, and their variants. Other embodiments are possible that use games other than card games in the array. For example, as discussed above, the wagering game can be applied to slot-type games that use traditional slot-type symbols such as cherries, plums, and oranges. In one embodiment, the primary games may be a poker type game (requiring winning poker hands on the primary game paylines) and the secondary games may be a slot-type game (requiring a repetition of specified indicia on a secondary payline).

A number of different methods may be used to convert the indicia forming the winning primary game outcomes to symbols. For example, in the case of a three card stud poker game, each class of winning primary game outcome (e.g., Straight, Pair, Three of a Kind, etc.) may be converted to a symbol corresponding to that class of game outcome. Consequently, the secondary game array may be filled with the corresponding game outcome class for each winning primary game outcome.

For example, the primary game array may have a payline containing a Jack, Queen, and King. This winning primary game outcome may be converted to a "STRAIGHT" symbol indicating the class of winning primary game outcome and included in the secondary game array. In this embodiment, if three "STRAIGHT" symbols in the secondary game array are on an active payline, a winning secondary game outcome is formed.

In another embodiment, a primary game array with multiple winning game outcomes may determine a single symbol for that primary game array for inclusion into the secondary game array. For example, the determined symbol may be a function of the number of winning primary game outcomes in a single primary game array. If only one game outcome is received in a primary game array, the corresponding symbol for the secondary game array is C. If two winning primary game outcomes are received in a single primary game array, the player receives the symbol B. If three or more winning primary game outcomes are received in a single primary game array, the player receives the symbol A. In this embodiment, a pay table may be used to identify winning combinations of symbols (i.e., A, B, C) and the award for each winning combination. If no winning primary game outcomes are received in a primary game array, the player may receive a null symbol or otherwise a symbol that does not assist in the development of a secondary winning game outcome.

In still another embodiment, a primary game array with multiple winning game outcomes may have a single symbol determined based on the cumulative value of the winning game outcomes. For example, the symbol for one large winning game outcome may be the same as the symbol for three small winning game outcomes in the same primary game array. A smaller winning game outcome (for example, in a specified value range) receives a different symbol.

In contrast, in the embodiment illustrated in FIGS. 5 and 6, the corresponding symbol matches the indicia determining a winning primary game outcome. As a primary game array may have multiple winning primary game outcomes, each array position in the secondary array may have multiple symbols corresponding to the winning primary game outcomes.

Paylines are generally predetermined for any given array. Although the paylines for the various embodiments described above are horizontal, vertical, and diagonal for ease of illustration; other embodiments may include paylines that may take any desired geometry. Consequently, both the primary and the secondary game arrays may have any desired payline configuration. Furthermore, the number of repeating symbols and the location of the symbols on the payline required for a winning game outcome may vary for the slot type games.

For example, winning game outcomes may be determined using similar criteria as traditional slot-type games; for example, certain symbols (e.g., cherries), in a specified order (e.g., left to right), repeated a specified number of times. The symbols themselves may represent different monetary values; one symbol paying more than another symbol based on the probability of that symbol appearing in the game array.

The awards associated with winning primary game outcomes are typically contained in a pay table that lists all the potentially winning combinations of indicia and the amount of the award for those indicia combinations. In one embodiment, the primary game pay table may also contain a symbol corresponding to each of the winning primary game outcomes. This pay table facilitates the determination of the symbol associated with each winning primary game outcome to form the secondary array. In this embodiment, a secondary game array pay table contains all the potentially winning combinations of symbols and the award amount for those symbol combinations in the second array.

In other embodiments, however, the primary game pay table may only identify a symbol for play in the secondary game array and not provide a monetary award. In this embodiment, a secondary game array pay table provides all the winning combinations of symbols and a monetary award for each of the winning secondary game outcomes. Consequently, in this embodiment, only the secondary game array provides a monetary award; although there is still a winning primary game outcome which provides a symbol instead of a monetary award.

In some embodiments, a winning wagering game outcome may take into consideration both winning primary game outcomes and winning secondary game outcomes to derive, in combination, a total monetary award. This combination of winning primary game outcomes and secondary game outcomes may provide a monetary award that is greater than the individual awards available in other embodiments for winning primary and secondary game outcomes that are individually compensated. Consequently, the winning wagering game outcome may take into consideration winning primary and secondary game outcomes either individually or in combination.

Although the embodiments discussed above use the symbols designated by paylines in the secondary game arrays to determine winning secondary game outcomes, other methodologies are available to determine winning secondary game outcomes. For example, each of the array positions in the secondary game array may have a designated award associated with it. A symbol assigned to a secondary array position, in one embodiment, captures that award.

While the invention has been illustrated with respect to several specific embodiments, these embodiments are illustrative rather than limiting. Various modifications and additions could be made to each of these embodiments as will be apparent to those skilled in the art. For example, the wagering game described herein could also be played as a non-wagering game; requiring no monetary wager to play the game. Winning game outcomes in a non-wagering may receive, in one embodiment, may only receive points (with no monetary) value to keep score. Accordingly, the invention should not be limited by the above description or of the specific embodiments provided as examples. Rather, the invention should be defined only by the following claims.

The invention claimed is:

1. A method of playing a wagering game on a gaming machine, comprising:

receiving a wager with a wager acceptor;

executing a game program with a processor to determine a wagering game outcome, wherein the game program comprises:

randomly selecting indicia from an indicia set;

forming a plurality of primary game arrays with the indicia, wherein each primary game array having of a plurality of rows and columns of symbol positions;

assigning each of the plurality of primary game arrays to one of a plurality of secondary array positions to form a secondary game array;

identifying winning primary game outcomes in the plurality of primary game arrays;

determining a symbol for each of the plurality of primary game arrays having at least one winning primary game outcome as a function of the winning primary game outcomes;

replacing each of the primary game arrays having at least one winning primary game outcome with the symbol determined to be used for the secondary array positions; and identifying a winning secondary game outcome in the secondary game array based on the symbol determined for each of the secondary array positions;

presenting the wagering game on a video display; and providing an award with a payout mechanism for a winning wagering game outcome.

2. The method of claim 1, wherein the award is provided for both the winning primary game outcomes and the winning secondary game outcome.

3. The method of claim 1, wherein the indicia in predetermined primary array positions in each of the plurality of primary game arrays determine the winning primary game outcomes.

4. The method of claim 3, wherein the symbol in each of a plurality of predetermined secondary array positions in the secondary game array determines the winning secondary game outcome.

5. The method of claim 4, wherein determining the symbol includes determining a plurality of symbols for one of the secondary array positions, each of the plurality of symbols corresponding to one of the winning primary game outcomes in one of the plurality of primary game arrays.

6. The method of claim 5, wherein the plurality of symbols in one of the secondary array positions are each considered independently of the other symbols in the same secondary array position to identify each winning secondary game outcome.

7. A method of playing a wagering game on a gaming machine, comprising:

receiving a wager with a wager acceptor;

executing a game program with a processor to determine a wagering game outcome, wherein the game program comprises:

randomly selecting indicia from an indicia set;

forming a plurality of primary game arrays with the indicia, wherein each primary game array having of a plurality of rows and columns of symbol positions;

identifying winning primary game outcomes in the plurality of primary game arrays;

determining a symbol for each of the primary game arrays having at least one winning primary game outcomes as a function of the winning primary game outcomes;

assigning the symbol determined for each of the primary game arrays to a secondary array position in a secondary game array; and identifying a winning secondary game outcome in the secondary game array;

presenting the wagering game on a video display; and providing an award for a winning wagering game outcome.

8. The method of claim 7, wherein the indicia in predetermined primary array positions determine the winning primary game outcomes.

9. The method of claim 8, wherein the symbol in each of a plurality of predetermined secondary array positions determines the winning secondary game outcome.

10. The method of claim 7, wherein the winning wagering game outcome is provided for both the winning primary game outcomes and the winning secondary game outcome.

11. A gaming machine for executing a wagering game, comprising:

a wager acceptor for accepting a wager;

a video display for displaying the wagering game;

a processor for:

randomly selecting indicia from an indicia set;

forming a plurality of primary game arrays with the indicia, wherein each primary game array having of a plurality of rows and columns of symbol positions;

identifying winning primary game outcomes in the plurality of primary game arrays;

determining a symbol corresponding to each of the winning primary game outcomes;

assigning the symbol for each of the winning primary game outcomes to a secondary array position in a secondary game array; and identifying a winning secondary game outcome in the secondary game array; and a payout mechanism for providing an award for a winning wagering game outcome.

12. The gaming machine of claim 11, wherein the award for the winning wagering game outcome is provided for both the winning primary game outcomes and the winning secondary game outcome.

13. The gaming machine of claim 11, wherein the indicia in predetermined primary array positions determine the winning primary game outcomes.

14. The gaming machine of claim 13, wherein the symbol in each of a plurality of predetermined secondary array positions determines the winning secondary game outcome.

15. A method of playing a wagering game on a gaming machine, comprising:

receiving a wager with a wager acceptor;

executing a game program with a processor to determine a wagering game outcome, wherein the game program comprises:

randomly selecting indicia from an indicia set;

forming a plurality of primary game arrays with the indicia, wherein each primary game array consisting of a plurality of rows and columns of symbol positions;

assigning each of the plurality of primary game arrays to one of a plurality of secondary array positions to form a secondary game array;

receiving a selection of one of the primary game arrays;

replacing the primary game array selected with another randomly determined primary game array;

identifying winning primary game outcomes in the plurality of primary game arrays;

determining a symbol for each of the primary game arrays having at least one winning primary game outcome as a function of the winning primary game outcomes;

replacing each of the primary game arrays having at least one winning primary game outcome with the symbol determined to be used for the secondary array positions;

identifying a winning secondary game outcome in the secondary game array formed with the replacement of each of the primary game arrays with the symbol determined;

presenting the wagering game on a video display; and providing an award with a payout mechanism for a winning wagering game outcome.

16. The method of claim 15, wherein indicia in predetermined primary array positions in each of the plurality of primary game arrays determines the winning primary game outcomes.

17. The method of claim 16, wherein the symbol in each of a plurality of predetermined secondary array positions determines the winning secondary game outcome.

18. The method of claim 17, wherein determining the symbol includes determining a plurality of symbols for one of the secondary array positions, each of the plurality of symbols corresponding to one of the winning primary game outcomes in one of the plurality of primary game arrays.

19. The method of claim 18, wherein the plurality of symbols in one of the secondary array positions are each considered independently of the other symbols in the same secondary array position to identify each winning secondary game outcome.

* * * * *

UNITED STATES PATENT AND TRADEMARK OFFICE

CERTIFICATE OF CORRECTION

PATENT NO. : 8,393,950 B1
APPLICATION NO. : 12/584447
DATED : March 12, 2013
INVENTOR(S) : Michael L. White It is certified that error appears in the above-identified patent and that said Letters Patent is hereby corrected as shown below:

In the Claims:

Column 10, line 19 replace “having of a” with --having a--.

Column 11, line 2 replace “having of a” with --having a--.

Column 11, line 33 replace “having of a” with --having a--.

Column 12, lines 9-10 replace “consisting of a” with --having a--.

Signed and Sealed this
Thirty-first Day of December, 2013

Margaret A. Focarino

Margaret A. Focarino
*Commissioner for Patents of the United States Patent and Trademark Office*

UNITED STATES PATENT AND TRADEMARK OFFICE

CERTIFICATE OF CORRECTION

PATENT NO. : 8,393,950 B1
APPLICATION NO. : 12/584447
DATED : March 12, 2013
INVENTOR(S) : Michael L. White It is certified that error appears in the above-identified patent and that said Letters Patent is hereby corrected as shown below:

In the Claims:

In Claim 1, column 10, line 20 replace “symbol positions” with --indicia positions--.

In Claim 7, column 11, line 3 replace “symbol positions” with --indicia positions--.

In Claim 7, column 11, lines 7-8 replace “at least one winning primary game outcomes” with --at least one winning primary game outcome--.

In Claim 11, column 11, line 34 replace “symbol positions” with --indicia positions--.

In Claim 15, column 12, lines 10-11 replace “symbol positions” with --indicia positions--.

Signed and Sealed this
First Day of April, 2014

Michelle K. Lee

Michelle K. Lee
*Deputy Director of the United States Patent and Trademark Office*